US005816173A

United States Patent [19]

Warneford

[11] Patent Number: 5,816,173

[45] Date of Patent: Oct. 6, 1998

[54] PALLET MADE FROM PLASTIC FLUTE BOARD

[76] Inventor: Peter John Warneford, Unit 23, 7 Carrington Road., Castle Hill NSW 2154, Australia

[21] Appl. No.: 750,235

[22] PCT Filed: Jun. 1, 1995

[86] PCT No.: PCT/AU95/00331

§ 371 Date: Jan. 23, 1997

§ 102(e) Date: Jan. 23, 1997

[87] PCT Pub. No.: WO95/32901

PCT Pub. Date: Dec. 7, 1995

[30] Foreign Application Priority Data

Jun. 1, 1994 [AU] Australia ..... PM 6041

[51] Int. Cl.[6] ..... B65D 19/18

[52] U.S. Cl. ..... 108/56.3; 108/56.1; 108/51.1; 108/901

[58] Field of Search ..... 108/51.1, 901, 108/902, 51.3, 56.3, 56.1

[56] References Cited

U.S. PATENT DOCUMENTS

| | | | |
|---|---|---|---|
| 3,113,532 | 12/1963 | White | 108/56.1 X |
| 3,131,656 | 5/1964 | Houle | 108/51.3 |
| 3,438,164 | 4/1969 | Duepree | 108/902 X |
| 3,710,733 | 1/1973 | Story | 108/51.1 |
| 4,145,975 | 3/1979 | Colbert | 108/901 X |
| 4,185,565 | 1/1980 | Nymoen | 108/51.3 |
| 4,303,020 | 12/1981 | Houle | 108/51.3 |
| 4,507,348 | 3/1985 | Nagata et al. | 108/901 X |
| 4,906,510 | 3/1990 | Todor, Jr. et al. . | |
| 5,320,048 | 6/1994 | Feiner | 108/902 X |
| 5,383,409 | 1/1995 | Hayakawa | 108/51.3 |
| 5,433,156 | 7/1995 | Hutchison | 108/56.1 X |
| 5,445,084 | 8/1995 | Durand | 108/56.3 |
| 5,456,189 | 10/1995 | Belle Isle | 108/902 X |
| 5,531,165 | 7/1996 | Taravella et al. | 108/56.3 X |

FOREIGN PATENT DOCUMENTS

| | | | |
|---|---|---|---|
| 17035 | 7/1969 | Australia . | |
| 1169077 | 12/1958 | France | 108/51.3 |
| CH 401 831 | 10/1965 | Germany . | |
| 06 298 249-A | of 0000 | Japan . | |
| 406144440 | 5/1994 | Japan | 108/51.1 |
| 1564495 | 4/1980 | United Kingdom | 108/51.3 |

*Primary Examiner*—Peter M. Cuomo
*Assistant Examiner*—Hanh V. Tran
*Attorney, Agent, or Firm*—Merchant, Gould, Smith, Edell, Welter & Schmidt

[57] ABSTRACT

A pallet (1) which has its primary structural members (6, 7, 8, 9) manufactured of a plastics material (10) comprising a top sheet (11), a bottom sheet (12) and a plurality of interconnecting supporting ribs (13). Generally, the members (6, 7, 8, 9) are folded to interconnect to provide compressive strength to the pallet (1). In alternative embodiments (FIGS. 11, 13, 15), a planar member (32, 51, 52) formed of the material (10) and interconnected supports (33, 41, 53) are provided to create a pallet structure.

15 Claims, 7 Drawing Sheets

PALLET MADE FROM PLASTIC FLUTE BOARD

FIELD OF THE INVENTION

The present invention relates to pallets and similar apparatus used for storing and transporting goods and, in particular, discloses a pallet manufactured from plastics materials.

BACKGROUND ART

Pallets are well known in industry and relate to portable platforms used to facilitate the handling of goods. Generally, the goods are stacked on the pallet which provides a sufficient ground clearance whereby the pallet may be lifted, typically by means of a forklift truck or crane, to permit relocation of the pallet and the goods stacked thereon for either storage or transportation.

Typically, pallets are manufactured from hardwood materials and, in Australia, such pallets generally have a capacity to support approximately two tonnes of goods. The manufactured cost of such a pallet is approximately A$25. Such pallets however are typically quite heavy and not conducive to manual handling. Also, wooden pallets, because of their nature, are difficult to clean and, over time, can rot which can result in a significant biological hazard. For these reasons, wooden pallets are not preferred for use for the transportation of fresh foods, pharmaceuticals, and like goods.

Pallets manufactured from plastics materials are known and are manufactured by moulding using rigid plastics materials to form a reinforced structure. Plastic pallets of this type are expensive and generally cost approximately A$100 to manufacture. Further, such pallets are relatively heavy, whilst having a strength comparable to that of hardwood pallets.

It will be apparent from the foregoing that known pallets suffer the significant disadvantage of a relatively high weight and/or a high manufactured cost. The weight problem associated with these types of pallets is of significant importance in transportation of goods, particularly by air, where the weight of the pallet can substantially increase the cost of transporting a load.

SUMMARY OF THE INVENTION

It is an object of the present invention to substantially overcome, or at least ameliorate, some or all of the above-mentioned problems through provision of an alternate pallet structure.

In accordance with a broad aspect of the present invention there is disclosed a pallet comprising a plurality of interconnected structural members characterised in that at least one of said structural members is manufactured of plastics material and comprises an upper sheet, a lower sheet and a plurality of rib supports interconnecting said upper and lower sheets.

In accordance with one aspect of the present invention there is disclosed a pallet comprising a plurality of interconnected structural members manufactured of plastics material, each of said structural members comprising an upper sheet, a lower sheet and a plurality of rib supports interconnecting said upper and lower sheets, a first group of the structural members defining at least one planar surface of said pallet, and a second group of said structural members defining one or more supporting arrangements for said planar surfaces.

In the preferred embodiment, the structural members are folded such that each structural member is an element of each group. Most preferably, the structural members are sized such that when folded, they inter-engage or abut to form the pallet.

Preferably, where surfaces of two or more of said structural surfaces inter-engage, a fastener can be used to prevent disengagement or warping.

Also preferably, abutting portions of separate structural members can be welded or fused together.

In another embodiment, the pallet is formed using a plurality of pallet portions, each of the pallet portions comprising a structural member of the first group, and a plurality of structural members of the second group each defining a pillar configured to support the planar surface.

Preferably the pillars are fused to the planar surface and are tubular and define a like plurality of openings in the planar surface whereby the pallet portions, in one configuration, can be stacked upon each other such that the pillars of an overlying pallet portion pass through the corresponding opening of the underlying pallet portion.

In an alternate configuration, a plurality of interconnecting sleeves are provided whereby two of the pallet portions can be adjoined by inter-engaging corresponding pillars of the pallet portions with one of the sleeves.

Most preferably, the structural members are formed from polypropylene which is extruded to form the upper and lower sheets and the rib supports. Generally the thickness of the structural members is 9 mm.

BRIEF DESCRIPTION OF THE DRAWINGS

A number of preferred embodiments of the present invention will now be described with reference to the drawings in which.

BEST AND OTHER MODES FOR PERFORMING THE INVENTION

Figure 1:
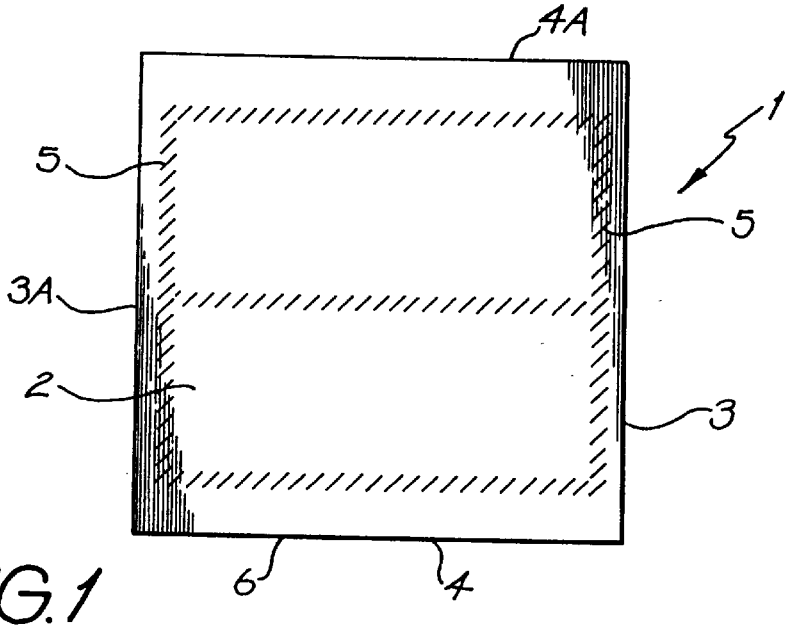
FIG. 1 is a plan view of a pallet of a first embodiment.

Referring to FIGS. 1 to 4, a pallet 1 is shown which has a top planar surface 2 preferably of dimensions 1165×1165 mm, a front face 3 having a corresponding and opposite rear face 3A, and a side surface 4 having a corresponding and opposite side face 4A. Other dimensions, such as 1200×1000 mm or 1000×1000 mm, which may be more appropriate for sea going or air transport situations, can alternatively be used. Typically, the pallet 1 has a height dimension of 150 mm corresponding to the height of the side surface 4. The planar surface 2 is preferably formed without any apertures or holes, which in prior an pallets, has permitted goods to fall through the pallet. As better seen in the underside view of FIG. 3, the pallet 1 is formed by a combination of a first structural member 6, a second structural member 7, four third structural members 8, and two fourth structural members 9.

Figure 4:
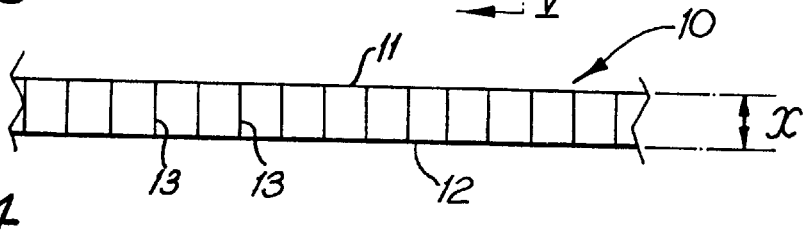
FIG. 4 is a cross-sectional view of the substrate material used in the formation of the pallet of FIG. 1.

Each of the structural members 6, 7, 8 and 9 is manufactured from an extruded polypropylene substrate 10 illustrated in FIG. 4. The substrate 10 includes a first planar portion 11 and a second planar portion 12 between which are a plurality of flute-like separating ribs 13 which provide rigidity to the substrate 10. Such a substrate is known and has been manufactured in sheet form to a thickness (X as seen in FIG. 4) of 4 mm by Corex Pry Limited of Melbourne, Australia and sold under the trade marks CORFLUTE and FLUTEBOARD. The 4 mm CORFLUTE bas traditionally been used to replace cardboard and like materials used in the manufacture of boxes and the like. Traditionally, in such applications, the CORFLUTE is cut to a particular pattern whereby it may be folded in an interlocking manner to form a box or carton which may, be subsequently unfolded.

However, in the preferred embodiment the extruded polypropylene substrate material 10 is preferably of a thickness (X) of approximately 9 mm which provides a substantial rigidity to the substrate 10 sufficient to be used in a pallet structure.

Referring to FIGS. 5 to 8B, the manner in which the structural members 6, 7, 8 and 9 are connected is illustrated. The structural member 6, which forms the top surface 2 of the pallet 1, has its side surfaces 4, 4A formed by folding a first sheet of the preferred substrate material, from which the structural member 6 is formed, to provide two channels 14 having a substantially square cross-section. Each of the channels 14 includes an surface 15 that faces the other surface 15 and extends towards, or lie in a plane substantially perpendicular, to an underside 16 of the top surface 2. The surfaces 15 do not contact the underside 16 but rather leave a space 17 within which the structural member 7 can be located.

Figure 7:
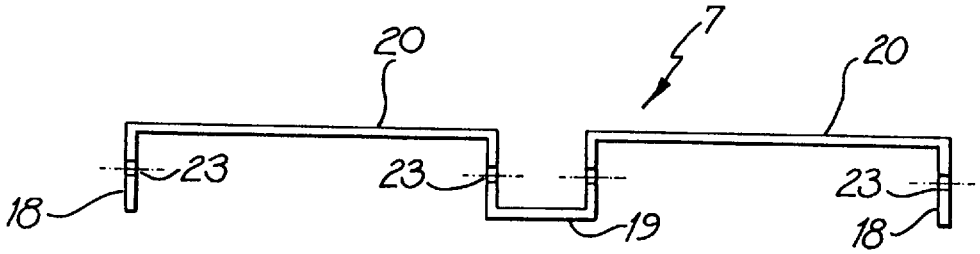
FIG. 7 is a cross-sectional view of a second sheet member used in the pallet of FIGS. 1 to 5.

As seen in FIG. 7, the structural member 7, is formed by folding a second sheet of the preferred substrate material to form two downwardly extending side supports 18, a central U-shaped support 19, and two planes 20 spanning between each of the side supports 18 with the U-shaped support 19 as illustrated. The structural member 7 is sized such that, as illustrated in FIG. 5, each side support 18 can extend behind the respective surface 15 and within the respective channel 14 of the structural member 6.

Figures 8A, 8B:
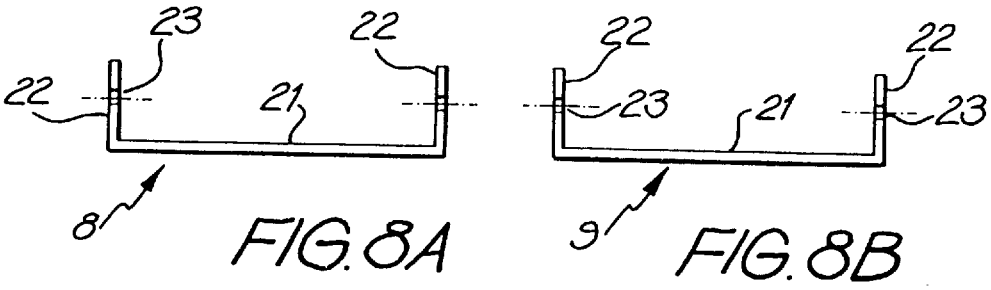
FIGS. 8A and 8B is a cross-sectional views of third and fourth sheet members, respectively, used in the pallet of FIGS. 1 to 5.

Turning now to FIGS. 8A and 8B, the structural members 8 and 9 have identical end elevation views but differ only in their length. Each of the members 8 and 9 are formed by folding appropriately sized third and fourth sheets of the preferred substrate material to form a substantial U-shape having a plane 21 and two upstanding side supports 22. In this manner, the structural members 8 and 9 are each configured to be received between the U-shaped support 19 of the structural member 7 and the surface 15 of the structural member 6.

In order to form the structural members 6, 7, 8 and 9, the substrate materials, once cut to size, are bent or folded at appropriate locations at 90 degrees to the direction of the rib 13 in the respective substrate material. Each bend is performed by applying a heat source in the form of a rod along the axis of the bend. At a predetermined temperature, the polypropylene substrate achieves a liquid or semi-liquid state at locations adjacent the rod. The material is then folded through 90 degrees by means of a pneumatically operated beading apparatus. On removal of the heat source the substrate returns to a solid state and consequently the axis of the bend is effectively welded in that position. Each bend or fold is performed in the same manner either as a single operation, or simultaneously with other bends (for example as with the member 6), depending on the type of bending apparatus being used.

Figure 5:
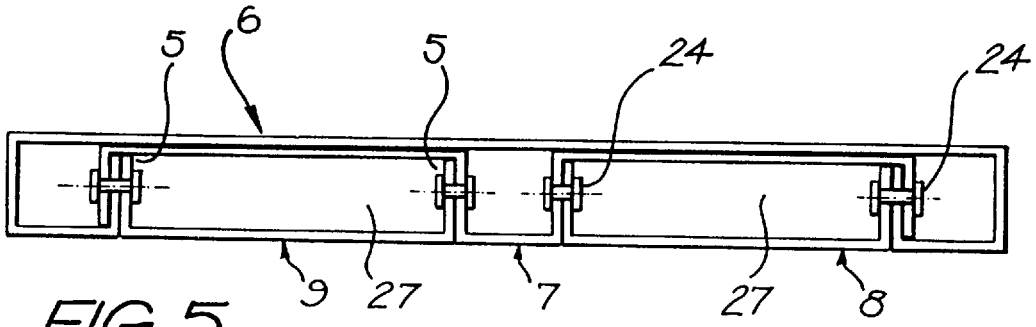
FIG. 5 is a cross-sectional view of the pallet of FIGS. 1 to 3 taken along the line V—V of FIG. 3.
Figure 6:
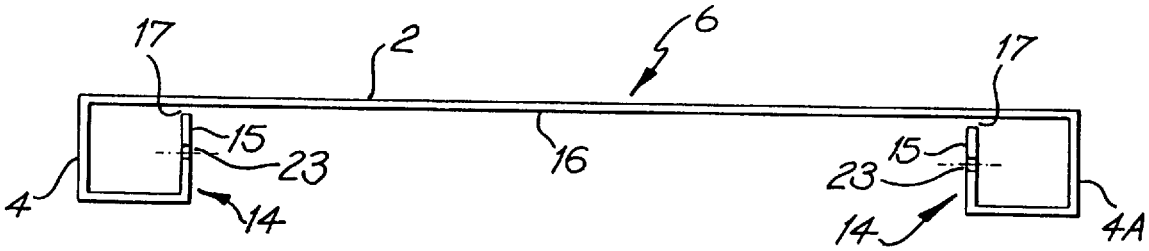
FIG. 6 is a cross-sectional view of a first sheet member used in the pallet of FIGS. 1 to 5.

Each of the structural members 6, 7, 8 and 9 includes a plurality of holes 23 that are alignable and permit the structural members 6, 7, 8 and 9 to be interconnected by means of a number of fasteners 24 seen in FIG. 5. The fasteners 24 are preferably manufactured from polypropylene and can incorporate a nut and bolt assembly, or alternatively, a snap-fit or fusible, rivet arrangement. Preferably, the fasteners have a diameter of between 8–12 mm.

Figure 17:
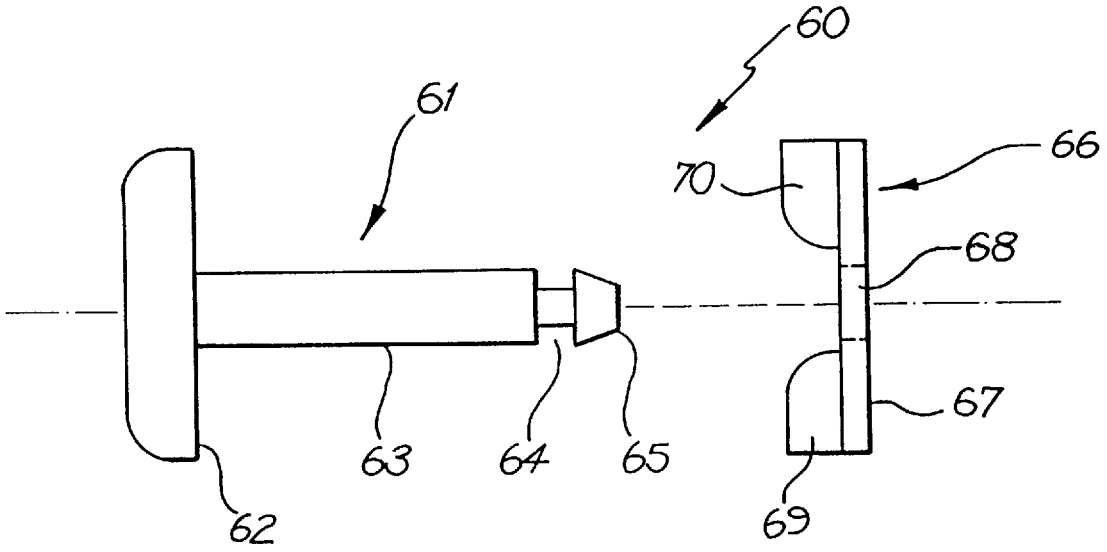
FIG. 17 is a side elevation view of a snap-fit fastener used in the preferred embodiment.

A preferred snap-fit fastener 60 is shown in FIG. 17 which includes a bolt 61 having a rounded head 62, and a shank 63. At the periphery of the shank 63 is an annular slot 64 and an adjacent chamfered tip 65. A nut 66 is also provided which has an aperture 68 located centrally through a disc 67. The tip 65 of the bolt 61 is sized to pass through the aperture 68 until the disc 67 becomes located and held within the slot 64. In view of the necessity of the bolt 61 having to pass through two or three layers of substrate material bolts 61 having shank lengths of preferably 18 mm and 27 mm are used. The disc 67 has extending therefrom toward the head 62, two flanges 69 and 70 which are configured to bite into the substrate material sandwiched between the head 62 and the disc 67, to ensure the disc 67 does not work itself free through rotation than can be caused by vibration.

Figure 9:
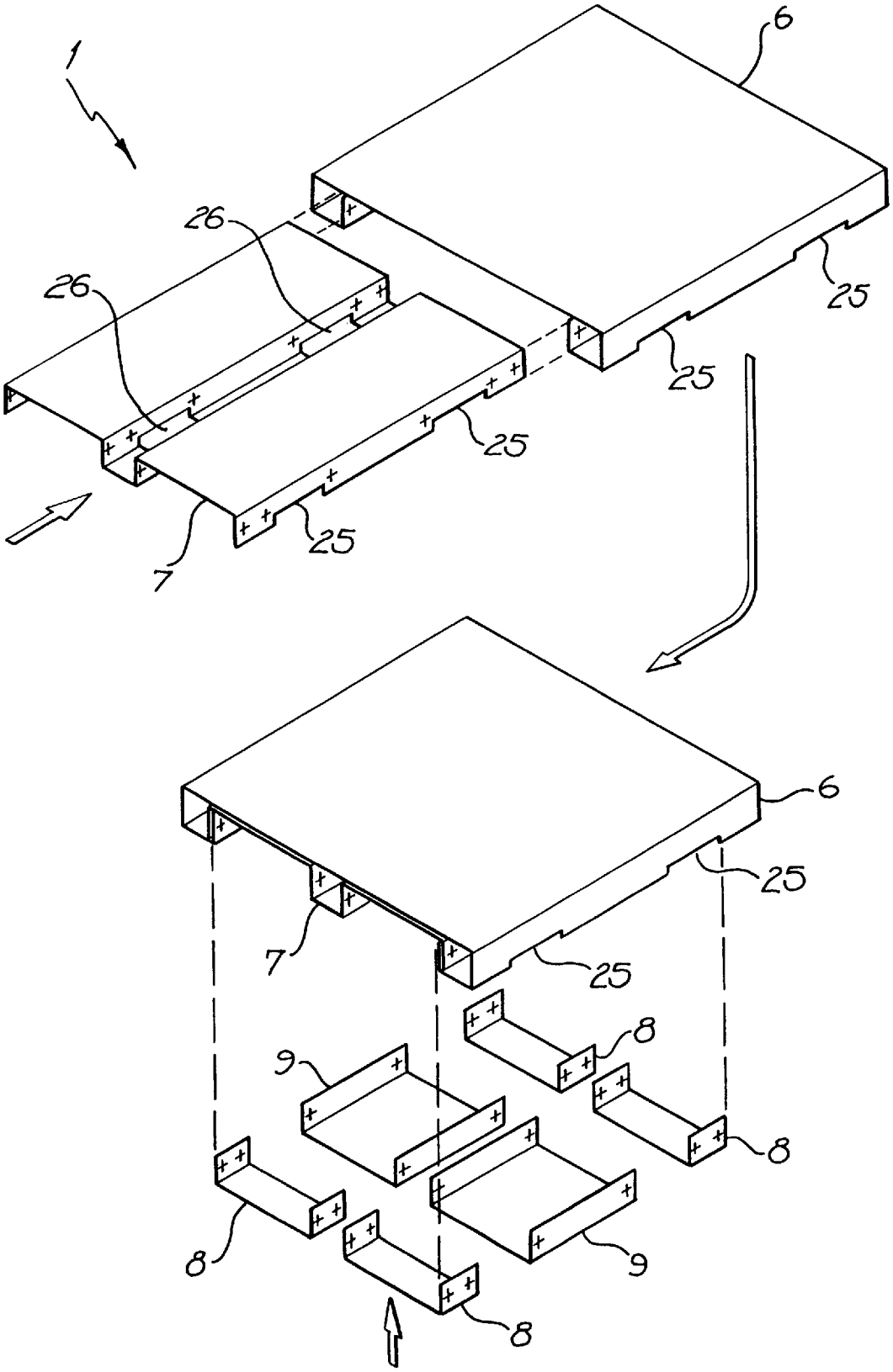
FIG. 9 is an exploded perspective view illustrating the assembly of the various sheet members of the pallet of FIGS. 1 to 8B.

Turning now to FIG. 9, the assembly of the pallet 1 is illustrated in which it is seen the structural member 7 is configured to slide into and beneath the structural member 6 until their holes 23 align whereupon the structural members 8 and 9 can be inserted underneath the combination of the structural members 6 and 7 for appropriate alignment of the holes 23 and securing using the fasteners 24.

Preferably, in addition, or in some configuration an alive, to joining the in structural members 6, 7, 8 and 9 with the fasteners 24, a heat fused join 5 can be formed that effectively welds the planes 20 of the member 7 to the underside 16 of the top surface 2 of the member 6. The join 5 is obtained by passing a wire (not illustrated) of high resistivity, such as Nichrome, through the structural member 6 in selected channels defined by the planar portions 11 and 12 and the ribs 13 above three beams defined by the channels 14 and the U-shaped support 19. An electric current is then passed through the wire which becomes hot and acts to melt the polypropylene substrates of the members 6 and 7 together.

Once assembled, and after fastening using the fasteners 24 and/or the fused join 5, the exposed edges of the substrate materials can be sealed, is preferred if the pallet 1 is to be used in situations where biological contamination can cause problems. One method of closing the open flute ends is to apply heat to the ends to liquefy the polypropylene sufficient to cause deformation that closes the channels between the ribs 13 and the end of each sheet. Alternatively, in some situations it may be appropriate to seal the ends using a silicone-type sealant.

Figure 2:
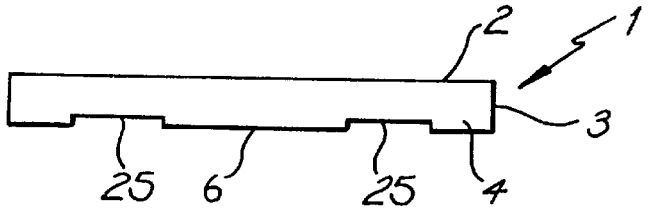
FIG. 2 is a side elevation view of the pallet of FIG. 1.
Figure 3:
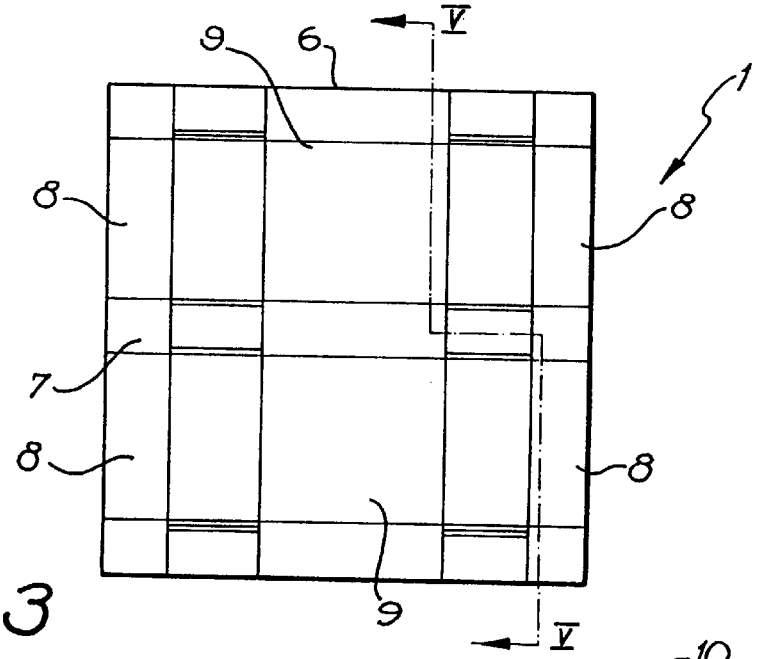
FIG. 3 is in inverse plan view of the pallet of FIG. 1.

As seen in FIGS. 2 and 9, each of support members 6 and 7 include a number of cut-out portions 25 and 26 which together form channels that enable the pallet 1 to be located on pallet racking systems if desired for storage. A number of other channels 27, shown in FIG. 5, formed by the location of the structural members 8 and 9 beneath the combination of the structural members 6 and 7, permit the pallet 1 to be lifted by the forks of a forklift pallet truck and/or by a crane in a manner corresponding to that of a conventional pallet.

It will be apparent that the folding of each of the members 6, 7, 8 and 9 forms a number of planar surfaces of the pallet 1, upon which goods can be placed or stacked. Further, such folding creates a number of beam-like supports, between and/or beneath the planar surfaces, which provide rigidity and strength to the pallet 1.

The preferred embodiment, when each of the structural members 6, 7, 8 and 9 is manufactured from 9 mm CORFLUTE weighs less than 15 kilograms, and typically between 10.0–10.5 kilograms, and is therefore of a weight suitable to be carried and/or moved by an individual. Such a pallet has an estimated maximum dynamic load of 1350 kg, an estimated maximum static load of 6000 kg, and can be manufactured at a cost of approximately A$50.

In view of the pallet 1 being manufactured of plastics material, it is resistant to destruction by pests as well as being more readily cleanable and therefore able to be sterilised for use with medical and food stores. Because the pallet 1 weighs somewhat less than similarly sized known hardwood and moulded plastic pallets, it can provide a significant cost saving in respect of transport costs. Alternative sizes for the pallet 1 include 1200×1000×125 mm, 1200×800×125 mm, or 1200×1200×125 mm, for example.

Figure 10:
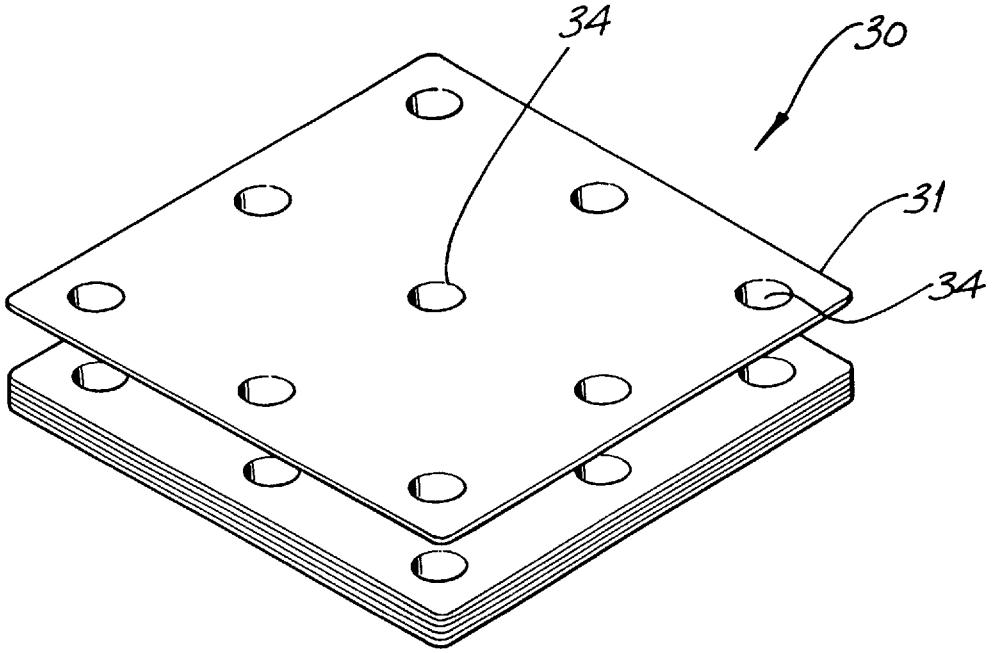
FIG. 10 is a perspective view of a stack of pallets of a second embodiment.
Figure 11:
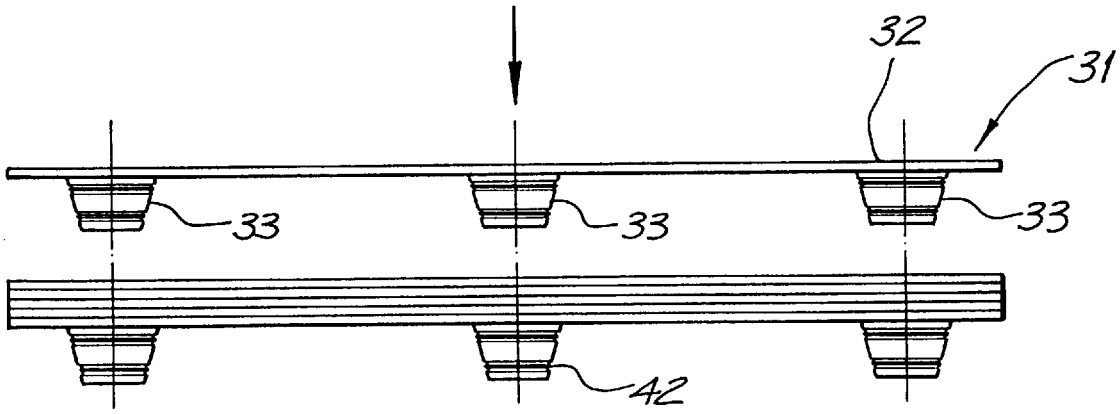
FIG. 11 is a side elevation view of the stack of FIG. 10.

Turning now to FIGS. 10 and 11, a composite pallet 30 is formed by a nested combination of a number of pallet structural members 31 which, in this embodiment number six. As seen, the pallet structural members 31 each include a square planar surface member 32 from which extends nine frustoconically shaped tube portions 33 each of which define a corresponding opening 34 in the surface member 32. It will be appreciated from FIGS. 10 and 11, that each of the pallet structural members 31 is able to be nested within another of the pallet structural members 31 through the tube portions 33 extending through the openings 34 to provide inter-engagement. By stacking a number of the pallet structural members 33 in a nested form as illustrated, the mechanical rigidity of the composite pallet 30 is substantially increased both in terms of its ability to withstand a substantial load as well as to be able to be lifted in the manner previously described. The tube portions 33 are preferably manufactured of injection moulded polypropylene and can be welded or fused to the structural member 31 in a similar manner to that described above. In particular, this can be performed on each of the tube portions 33 simultaneously using nine circular heat sources applied to the surface of the substrate material.

Depending on the load desired to be carried, a pallet structural members 31 can be used individually as a pallet in the traditional sense. Further, any combination of two or more of the pallet structural members 31 can be used to form a composite pallet. Also, the composite structure shown represents a convenient manner by which the individual pallet structural members 31 can be stored when not in use.

Figure 12:
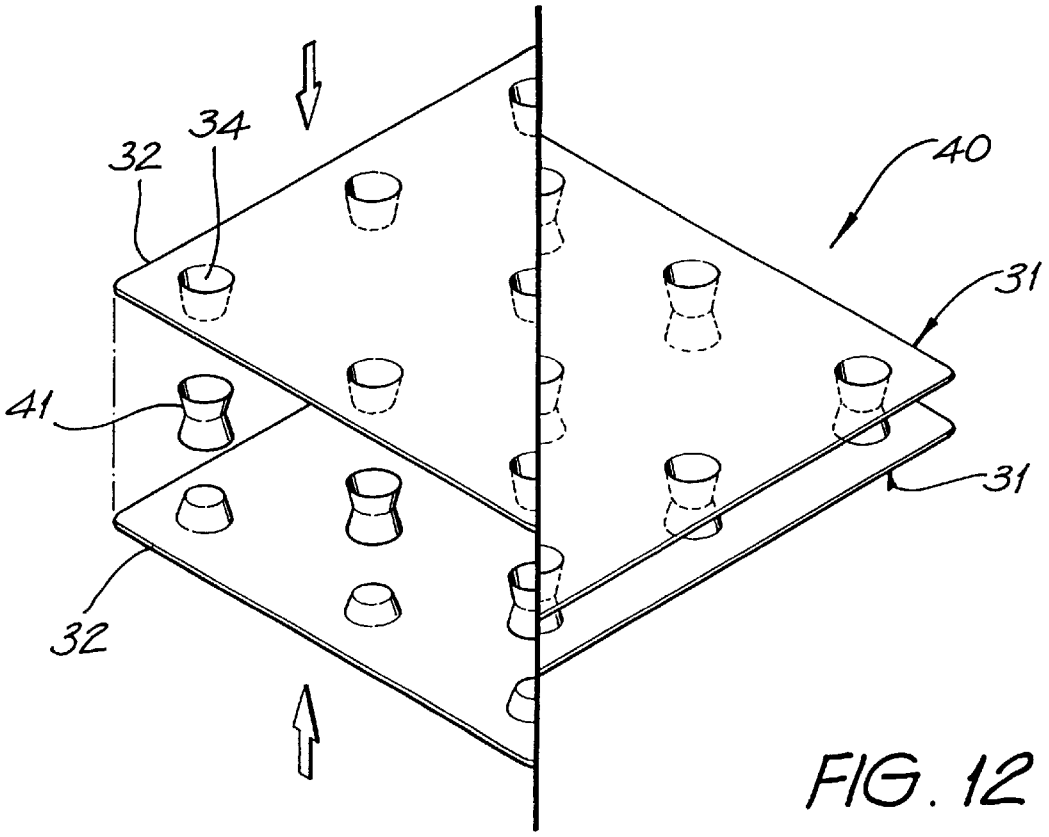
FIG. 12 is a split perspective exploded and normal view of a pallet of a third embodiment.
Figure 13:
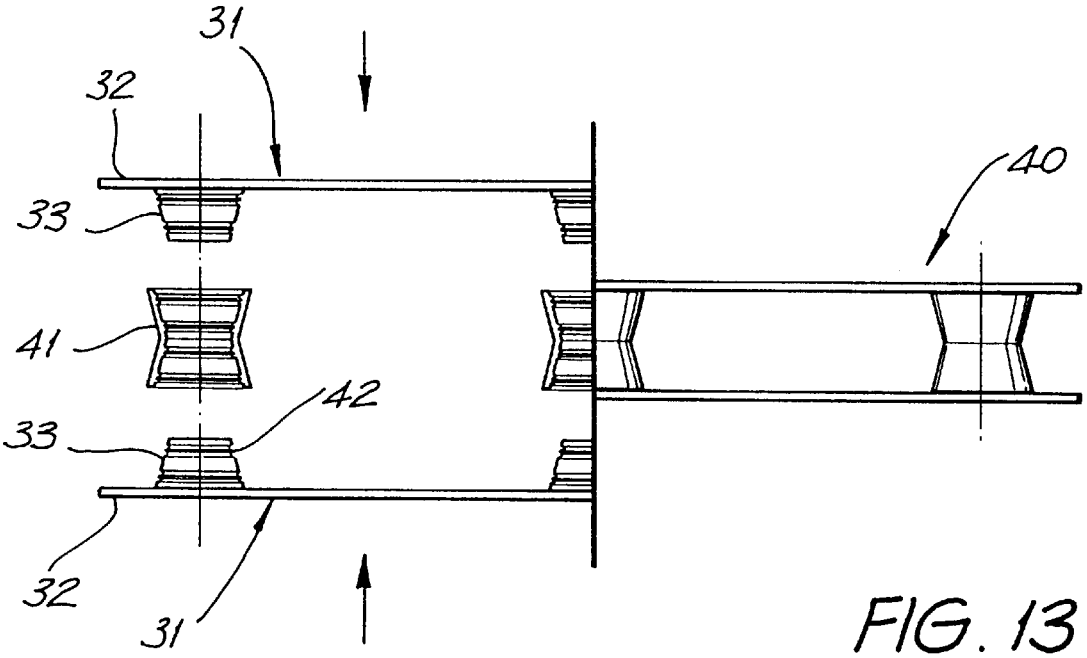
FIG. 13 is a side elevation representation of the view of FIG. 12.

A further embodiment of a pallet 40 is illustrated in FIGS. 12 and 13 which makes use of the pallet structural member 31 of FIGS. 10 and 11. In this embodiment, a separating tube 41 is provided and shaped to receive at each of its ends, one of the frustoconical tube portions 33. In this manner, and as illustrated, two of the pallet structural members 31 can be joined using a number, preferably nine, of the separating tubes 41.

In each of the embodiments of FIGS. 10 to 13, the tube portions 33 are provided with circumferential interior ribs 42 and the separating tubes 41 with circumferential exterior ribs, that permit the tube portions 33 and/or separating tubes 41 to interlock.

It will further be apparent from FIGS. 10 to 13 that, using a single type of pallet structural member 31, two types of pallet configurations 30 and 40 can be provided. In addition, where only the pallet 40 of FIGS. 12 and 13 is operatively used, when it is subsequently desired to store the pallets 40, they may be disassembled and stored in the nested fashion shown in FIGS. 10 and 11, thereby occupying substantially the reduced volume.

The pallet 40 shown in FIGS. 12 and 13 is generally configured in airline transportation and is approximately 1000×1000×80 mm in size. Such a pallet, when manufactured from 9 mm thick CORFLUTE substrate, weighs approximately 6–7 kilograms and can carry a load of approximately 750 kilograms.

Figure 14:
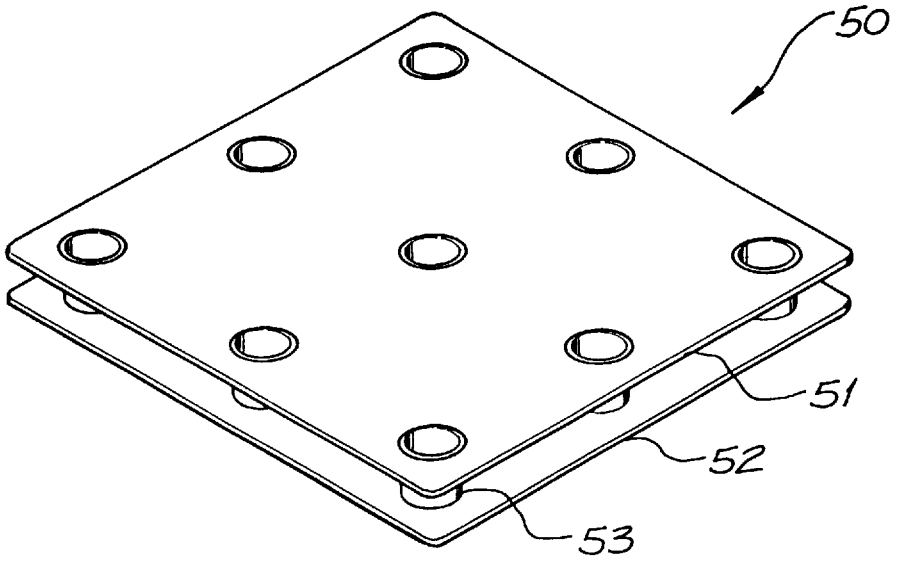
FIG. 14 is a perspective view of a pallet of a fourth embodiment.
Figure 15:
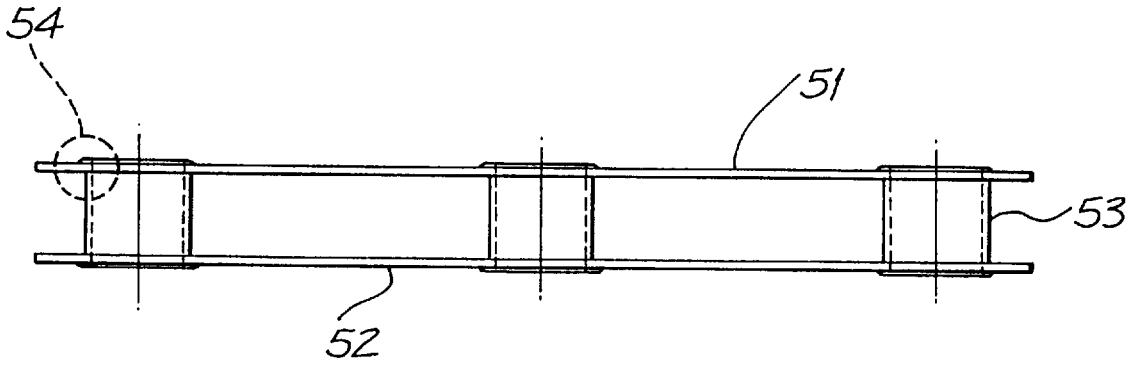
FIG. 15 is a side elevation view of the pallet of FIG. 14.

An alternative embodiment of an airline suitable pallet 50 is shown in FIGS. 14 and 15 where the pallet 50 is formed from two sheet members 51 and 52 of 9 mm CORFLUTE and interconnecting tubular separators 53 preferably manufactured of moulded polypropylene. The separator 53 can be welded to the sheet members 51 and 52.

Figure 16:
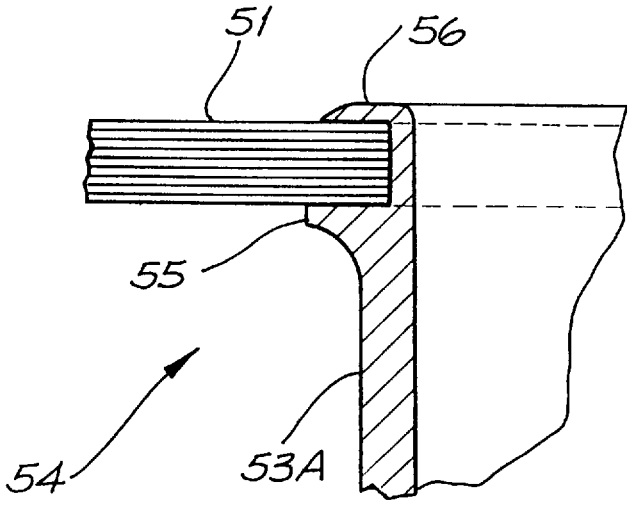
FIG. 16 is an enlarged cross-sectional view of a preferred form of a part of the pallet of FIGS. 14 and 15.

Alternatively, as illustrated in FIG. 16, an enlarged portion 54 of FIG. 15 illustrates a snap-fit interconnection of a preferred separator 53A with the sheet member 51. The separator 53A includes an underside lip 55 of relatively thick section, which is therefore substantially rigid and able to support compressive loads. A topside lip 56 is provided of relatively thinner section which permits the lip 56 to be biased around the edge of the aperture in the sheet member 51 to clasp and sandwich the sheet member 51 between the lips 55 and 56. The separator 53A is also preferably manufactured of moulded plastics material such as polypropylene. However, in view of the separator 53A providing a snap fit, other materials such as metals (eg. aluminium or lightweight alloys) can be used. Such a structure can also substitute for the tubes 33 and 41 of the embodiments of FIGS. 10 to 13.

The pallet 50 shown in FIGS. 14 and 15 is generally configured in airline transportation and is approximately 1000×1000×80 mm in size. Such a pallet, when manufactured from 9 mm thick CORFLUTE substrate and polypropylene separators 53A, weighs less than 7 kilograms and generally between 4.5–5.0 kilograms and can comfortably carry a load of approximately 750 kilograms. The estimated maximum dynamic load of such a pallet is 1000 kg and the estimated maximum static load is 4000 kg.

It will be apparent from the foregoing that an alternate pallet structure is disclosed which is of substantially reduced weight when compared with known pallet configurations and can be manufactured using known materials. The advantages of reduced weight and ease of cleaning coupled with an attractive manufactured cost permits utility of such pallets in the transportation of goods by air and/or relatively light weight packaged goods.

The foregoing describes only a number of embodiments of the present invention and modifications, obvious to those skilled in the art can be made thereto without departing from the scope of the preset invention.

Industrial Applicability

The pallet structure of the present invention find application in the transportation, storage and handling of goods.

I claim:

1. A pallet comprising:

a plurality of structural members each formed of an extruded substrate of plastics material, said substrate comprising an upper sheet, a lower sheet and a plurality of rib supports interconnecting said upper and lower sheets;

a first structural member forming a unitary upper planar surface of said pallet and having opposite ends folded to form corresponding substantially rectangular section channels beneath the upper surface;

at least one second structural member forming a lower planar surface substantially parallel to said upper planar surface, opposite ends of the second member each being folded to be substantially perpendicular to said planar surfaces and at least contactable with a parallel side of an adjacent one of said channels;

a third structural member having a substantially central U-shaped channel and two further planar surfaces each extending perpendicularly from a corresponding side of said channel beneath said upper planar surface and each having a peripheral end folded to contact and be parallel with at least one of said opposite ends; and joining means for fastening said at least one second structural member to the first structural member.

2. A pallet according to claim 1, wherein said second and third structural members slideably inter-engage with each other and said first structural member to form said pallet.

3. A pallet as claimed in claim 2, wherein at one or more locations at which surfaces of two or more of said structural surfaces inter-engage, a fastener is used to maintain inter-engagement of said surfaces.

4. A pallet as claimed in claim 2, wherein at least one abutting portion of said structural members are welded together.

5. A pallet as claimed in claim 2, wherein said at least one structural member is formed from polypropylene which is extruded to form the upper and lower sheets and the rib supports.

6. A pallet according to claim 2, wherein said joining means fastens at said U-shaped channel, said third member separately to each of said second members.

7. A pallet according to claim 2, wherein at least one of an exposed edge of said substrate is heat sealed.

8. A pallet according to claim 1, wherein each of said channels of said first structural member define a space between an edge of each said opposite folded ends and said upper surface, and said first and third structural members are inter-engaged by overlapping of each of their respective folded ends so that each of said spaces is occupied by a respective one of said further planar surfaces.

9. A pallet according to claim 1, comprising two second structural members, each having one folded end contactable with an adjacent channel of first member and the remaining folded end contactable with said U-shaped channel of said third structural member.

10. A pallet according to claim 9 wherein said joining means fastens at said channels of said first member, and each of said first, second and third members.

11. A method of forming a pallet comprising the steps of:

providing a plurality of sheets of extruded plastics material, each said sheet having an upper surface, a lower surface and a plurality of rib supports interconnecting said upper and lower surfaces;

bending opposite ends of a first sheet to form a first structural member with an upper planar surface, and a pair of substantially rectangular shaped channels beneath said upper planar surface;

bending opposite ends of a second sheet of said substrate to form at least one second structural member with perpendicular opposite ends;

associating said first structural member with said second structural member so that said perpendicular opposite ends are at least contactable with an adjacent one of said rectangular shaped channels;

associating a third structural member having a substantially central U-shaped channel with the first and second structural members, the third structural member having two further planar surfaces each extending perpendicularly from a corresponding side of said channel beneath said upper planar surface and each having a peripheral end folded to contact and be parallel with at least one of said opposite ends; and joining said contacting surfaces.

12. A pallet comprising:

a first member having a first substantially square planar surface and a pair of integrally formed elongate first and second channels beneath said square planar surface, each of said channels being substantially square in cross-section, and there being an opening into each of the channels at between an underside of said square planar surface and inner facing sides of said channels;

a second member disposed beneath said first member having an integrally formed substantially square section third channel centrally and having first and second rectangular planar surfaces extending form corresponding sides of said channel through a corresponding one of said openings, to a perpendicularly arranged periphery locatable against the corresponding one of said facing sides within the corresponding one of said first and second channel; and at least two third members each having a third rectangular planar surface having perpendicularly arranged ends integrally formed therewith and arranged to contact an adjacent one of said facing sides and said third channel, wherein said first, second and third channels, together with said third planar surfaces define a second square planar surface corresponding with and parallel to said first square planar surface, wherein each of said members is formed from a corresponding single piece of extruded polypropylene substrate having an upper sheet, a lower sheet and a plurality of parallel ribs arranged there between, and said members are joined at said channels.

13. A pallet as claimed in claim 12, wherein said substrate is at least 9 mm thick.

14. A pallet as claimed in claim 13, wherein said members are welded together by heating a wire being placed through selected channels defined by said upper and lower sheet and said ribs of said substrate.

15. A pallet as claimed in claim 13, wherein said members are fastened through a common penetration between structural member using a polypropylene fastener.

* * * * *

UNITED STATES PATENT AND TRADEMARK OFFICE

CERTIFICATE OF CORRECTION

PATENT NO. : 5,816,173

DATED : October 6, 1998

INVENTOR(S) : Warneford

It is certified that error appears in the above-identified patent and that said Letters Patent is hereby corrected as shown below:

Column 3, line 9, "an" should read —art—

Column 3, line 43, "an" should read —a—

Column 4, line 48, "alive" should read —alternative—

Signed and Sealed this

Twenty-ninth Day of June, 1999

*Attest:*

Q. TODD DICKINSON

*Attesting Officer*

*Acting Commissioner of Patents and Trademarks*